US006408221B1

(12) United States Patent
Demuth et al.

(10) Patent No.: US 6,408,221 B1
(45) Date of Patent: Jun. 18, 2002

(54) METHOD OF AND INSTALLATION FOR OPTIMIZING THE PROCESS OF CLEANING COTTON

(75) Inventors: Robert Demuth, Nuerensdorf; Jürg Faas, Dinhard; Peter Fritzsche, Winterthur; Eduard Nüssli, Wiesendangen, all of (CH)

(73) Assignee: Maschinenfabrik Reiter AG, Winterthur (CH)

( * ) Notice: Subject to any disclaimer, the term of this patent is extended or adjusted under 35 U.S.C. 154(b) by 1122 days.

(21) Appl. No.: 08/822,145

(22) Filed: Mar. 21, 1997

Related U.S. Application Data

(63) Continuation of application No. 07/905,531, filed on Jun. 29, 1992, now abandoned, which is a continuation of application No. 07/785,236, filed on Nov. 1, 1991, now abandoned, which is a continuation of application No. 07/524,744, filed on May 17, 1990, now abandoned.

(30) Foreign Application Priority Data

May 23, 1989 (CH) ..... 1929/89

(51) Int. Cl.[7] ..... G06F 19/00
(52) U.S. Cl. ..... 700/130; 700/143
(58) Field of Search ..... 364/470.01, 470.1, 364/470.13, 470.14; 19/65 A, 66 R, 105, 200–205, 300, 239, 240; 57/264, 265

(56) References Cited

U.S. PATENT DOCUMENTS

| | | | | |
|---|---|---|---|---|
| 3,894,314 A | | 7/1975 | Nayfa | 19/66 R |
| 4,317,260 A | * | 3/1982 | Blackburn | 19/107 |
| 4,494,204 A | * | 1/1985 | Hosel | 19/105 X |
| 4,535,511 A | * | 8/1985 | Leifeld et al. | 19/105 |
| 4,703,431 A | * | 10/1987 | Sako et al. | 364/470 |
| 4,723,344 A | * | 2/1988 | Leifeld | 19/105 |
| 4,858,277 A | * | 8/1989 | Pinto et al. | 364/470.13 X |
| 4,876,769 A | * | 10/1989 | Schlepper et al. | 19/105 |
| 4,928,353 A | * | 5/1990 | Demuth et al. | 19/105 X |

FOREIGN PATENT DOCUMENTS

| | | | |
|---|---|---|---|
| EP | 0193647 | 9/1986 | |
| EP | 193647 A1 * | 9/1986 | 364/470 |
| EP | 0311831 | 4/1989 | |
| EP | 0312805 | 4/1989 | |
| FR | 2534600 | 4/1984 | |

* cited by examiner

*Primary Examiner*—Leo P. Picard
*Assistant Examiner*—Chad Rapp
(74) *Attorney, Agent, or Firm*—Greenblum & Bernstein, P.L.C.

(57) ABSTRACT

To optimize the cleaning of cotton in a spinning milk, there is entered into a control original data concerning fiber characteristics and proportions of different types of contamination inherent to the origin of fiber cotton bales. Also there is entered into the control a desired degree of cleaning and a throughput quantity of the carded fiber sliver. The control delivers predetermined control signals based upon the entered original data, the throughput quantity of the carded sliver and the desired degree of cleaning. These control signals set adjustable operating members governing the rate of opening of the cotton bales by bale opening machines, the degree of cleaning of the cotton fibers by cleaning machines and the rate of processing of the cotton fibers by at least one carding machine.

11 Claims, 4 Drawing Sheets

METHOD OF AND INSTALLATION FOR OPTIMIZING THE PROCESS OF CLEANING COTTON

This application is a continuation, of application Ser. No. 07/905,531, filed Jun. 29, 1992, now abandoned, which is a continuation of application Ser. No. 07/785,236, filed Nov. 1, 1991, now abandoned, which is a continuation of application Ser. No. 07/524,744 filed on May 17, 1990, now abandoned.

BACKGROUND OF THE INVENTION

The present invention relates to a new and improved method of optimizing the process of cleaning cotton in a spinning mill with regard to throughput quantity of a carded or card sliver and fiber impairment of the processed product and with regard to residual dirt content in the processed product. The present invention also relates to a new and improved installation for carrying out and performing the inventive method.

In contrast to earlier spinning mills, in which the ring spinning method was the only yarn producing process, new spinning methods have been developed of late in different directive trends, which spinning methods impose different high requirements on the cleaning effect and on the permissible fiber impairment or damage during the cotton cleaning process.

These different requirements could not be optimally met or fulfilled by the hitherto customary cleaning methods with regard to the variability of the throughput quantity, the residual-dirt content and the permissible fiber impairment or with regard to the relationship thereof with respect to one another.

SUMMARY OF THE INVENTION

Therefore, with the foregoing in mind, it is a primary object of the present invention to provide a new and improved method of and installation for optimizing the degree of cleaning cotton and which are not afflicted with the drawbacks and limitations of the prior art methods.

An important further object of the present invention is directed to a new and improved method of optimizing the process of cleaning cotton and, in particular, the degree of cleaning, while taking into account the different high requirements imposed by respective spinning methods with regard to residual-dirt content and permissible fiber impairment. Fiber impairment occurs during fiber cleaning on account of relatively intensive fiber processing and treatment and results primarily in a shortening of the fibers, but also can result in an impairment of the strength and the elongation of the fibers.

Another and more specific object of the present invention aims at providing a new and improved method of and installation for optimizing the degree of cleaning and which take into account the fact that the fibers supplied to a spinning mill represent a blend or mixture of fibers of different provenances or origins, whereby such a blend represents, in turn, an optimization with regard to quality requirements of the finished yarn and with regard to economical requirements with reference to the raw cotton price and the yarn price.

The characteristic features of cotton fibers of different provenances or origins naturally concern the fineness and the length as well as the strength, the elongation and the color of the individual cotton fibers and, depending upon the manner of. the cotton picking- method, the cleanness or contamination of raw cotton.

Such contamination of raw cotton refers to very coarse types of contamination such as metal parts, strings, fabric residues and other foreign elements, but also to coarse parts of cottonseed husks of cottonseed hulls and lately to very fine parts of husks known as "seedcoat fragments" and which impose high requirements upon the cleaning machines of a spinning mill.

Other types of dirt, which are likewise contained in raw cotton, are the everyday or commonplace dust, dirt from the cotton fields and, to some extent, also the contamination of cotton by honeydew, a sticky or tacky sugar substance which adheres in the form of tiny droplets to the cotton fibers and causes considerable trouble to the spinning mills.

Continuing further, another important object of the present invention is directed to providing a new and improved method of and installation for optimizing the degree of cleaning cotton and which take into account the temperature of the fiber cleaning or processing rooms as well as the moisture content in such rooms and the moisture content in and at the surface of the cotton fibers.

Yet a further significant object of the present invention aims at providing a new and improved method of and installation for optimizing the process of clean cotton and by means of which there is achieved efficient and economical cotton cleaning in a spinning mill optimizing high throughput of the cotton material as required from the standpoint of commercial considerations in conjunction with accurate opening of the cotton bales and careful fiber cleaning as required from the standpoint of technological considerations. The result of such optimization can be quite different depending upon the use of the cleaned cotton fibers in one or the other of the spinning methods.

In order to meet or satisfy the technological requirements, in the first place the opening of the fiber bales should result in fiber flocks of the smallest possible flock size, in the second place the rotational speed of the opening or extraction rollers and the intensity of these opening or extraction rollers in combination with knife elements or carding elements should be such that fiber impairment or damage only occurs to a tolerable extent.

Now in order to implement these and still further objects of the present invention, which will become more readily apparent as the description proceeds, the method of the present development is-manifested, among other things, by the features that,.on the one hand, the fiber characteristics and the proportions of different types of contamination which are inherent to the provenance or origin of the cotton are entered as original or input or given data into control means and that, on the other hand, the desired degree of cleaning and the throughput quantity in m/min of the carded or card sliver are entered into the control means. These control means are programmed such that the control means deliver predetermined control signals based on the entered original or input or given data, the throughput quantity of the carded or card sliver and the entered desired degree of cleaning. Adjustable operating members are set or adjusted by means of these predetermined control signals, such adjustable operating members effecting the rate of opening of respective opening machines, the degree of cleaning. in respective cleaning machines and the rate of processing on at least one carding machine, whereby the adjustable operating members are set or adjusted in such a manner that the desired degree of cleaning and the throughput quantity of the carded or card sliver are achieved, while a presumable fiber impairment of the cotton fibers to be cleaned is indicated or displayed.

A further feature of the inventive method of optimizing the process of cleaning cotton is characterized in that the computed degree of cleaning is checked and monitored during the cleaning operation by means of sensory equipment or sensors located in the waste discharge space of the cleaning machines and, if necessary, automatically corrected.

As alluded to above, the invention is not only concerned with the aforementioned method aspects, but also relates to a new and improved installation for carrying out and performing the inventive method of optimizing the cotton cleaning process.

Generally speaking, the new and improved installation for producing a clean fiber sliver is of the type comprising at least one fiber-bale opener or opening device and a predetermined number of machines for cleaning the fiber flocks or fibers.

In order to implement the aforementioned objects of the present invention, which will become more readily apparent as the description proceeds, the installation constructed according to the invention for producing a cleaned fiber sliver is manifested, among other things, by the features that the fiber-bale opener or opening device and the machines for cleaning fibers are controllably adjustable with respect to the performance and the cleaning effect thereof, such performance being the throughput in weight per unit time such as kg/hr. The installation is further provided with a measuring device for determining the aforesaid performance as well as with a microcomputer control unit for controlling the fiber-bale opener or opening device and the machines for cleaning the fibers such that the fibers are only impaired within a predetermined or specified tolerance.

The advantages achieved by the invention are to be seen essentially in the fact that the cleaning intensity can be adapted to the prevailing requirements, whereby the relations between the cleanness of a carded or card sliver, the fiber impairment and the performance in n/min are in an optimal interrelationship to one another for producing t his carded or card sliver.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the installation for carrying out the inventive method of optimizing the process of cleaning cotton has been illustrated therein as is needed to enable one skilled in the art to readily understand the underlying principles and concepts of this invention.

Figure 1:
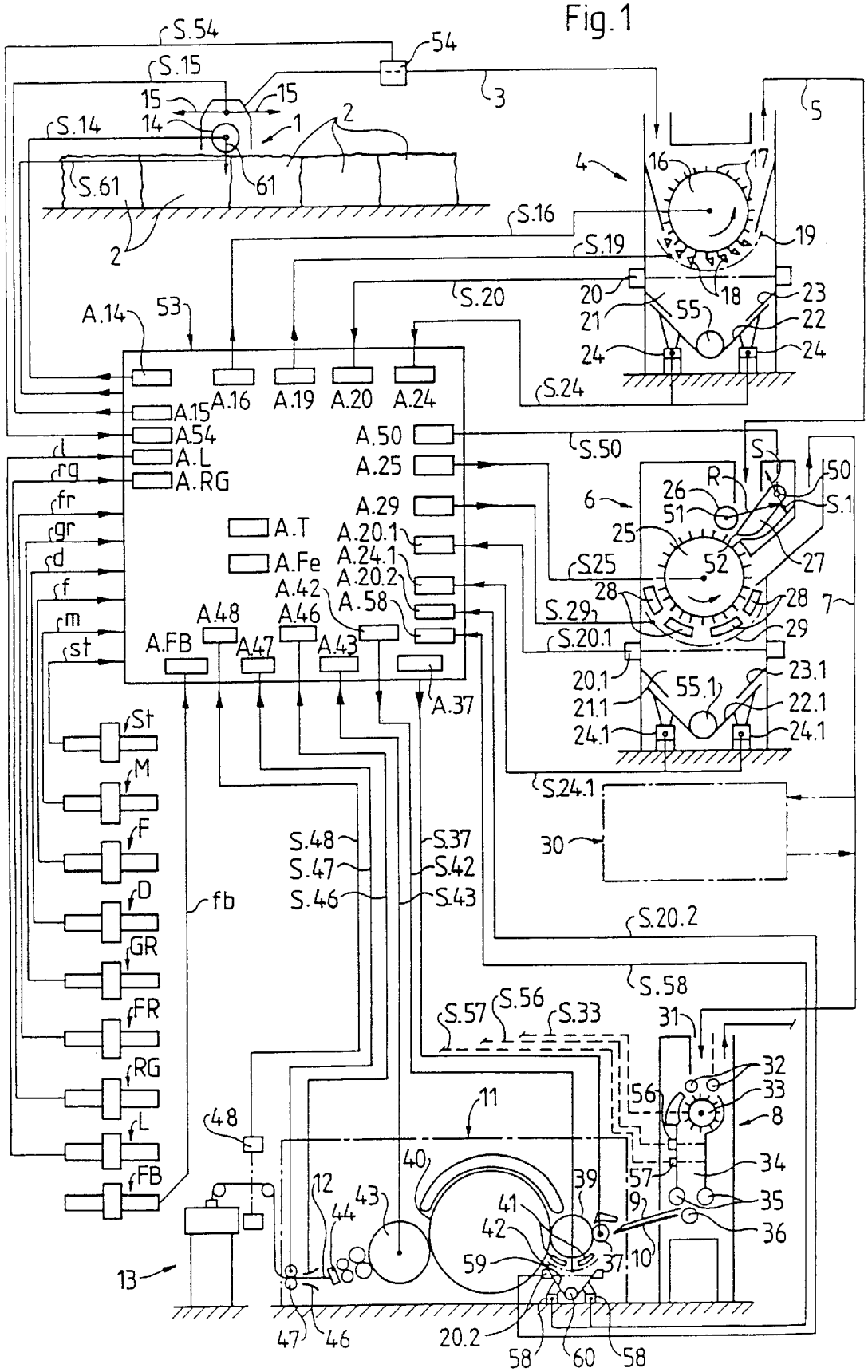
FIG. 1 is a schematic flow diagram showing the operation of cleaning machines in a spinning mill in accordance with the inventive method of optimizing the process of cleaning cotton.

Turning attention now specifically to FIG. 1 of the drawings, a bale opener or opening device 1 for extracting fiber flocks from fiber bales 2 and illustrated therein by way of example and not limitation will be seen to represent a bale-opener machine which is marketed world-wide under the Trademark UNIFLOC by the present Assignee, Rieter Machine Works Limited, located in Winterthur, Switzerland.

The fiber flocks extracted from the fiber bales 2 are transferred via a conveying route or path 3 to a first cleaning machine, for example, a coarse cleaning machine 4. The amount or quantity of fiber flocks conveyed per unit of time along the conveying route 3 can be determined, for instance in $m^3/h$, by means of a measuring or flowmeter device 54. However, such quantity measurement is not limited to this example. There is also the possibility of directly connecting such quantity measurement with the bale opener or opening device 1 or of completely omitting this quantity measurement and providing above each cleaning machine respective stock depots which will be described hereinafter.

In the coarse cleaning machine 4 yet to be described hereinbelow, dirt is removed and the pre-cleaned fiber flocks, already considerably reduced in size, are conveyed via a further conveying route or path 5 to a second cleaning machine, for example, a fine cleaning machine 6, whereby the fiber flocks are subjected to cleaning effected in a more intensive manner in comparison to the cleaning in the coarse cleaning machine 4, the fiber flocks being subsequently conveyed via a further conveying route or path 7 into a feeding device 8.

From this feeding device 8 a fiber batt or lap 9 arrives via a chute or slide 10 at a card or carding machine 11. A carded or card sliver 12 is conveyed from this card or carding machine 11 to a can coiler 13.

Having now had the benefit of the description of the cotton cleaning process starting with fiber flocks extracted from the cotton bales 2 and finishing with the carded or card sliver 12 leaving the card or carding machine 11, the individual devices and machines for carrying out the inventive method of optimizing the cotton cleaning process will now be considered in conjunction with FIG. 1 as follows:

Since, as already mentioned, the bale opener or opening device 1 is a well-known construction, the following disclosure of only essential details thereof should suffice for the understanding of the invention.

The bale opener or opening device 1 comprises at least one rotating extraction milling roller 14 which, during reciprocating motion thereof according to arrows 15, extracts fiber flocks from the surface of the fiber bales 2 and conveys the extracted fiber flocks, for instance pneumatically, via the conveying route 3.

The fiber flock size and the extraction performance, for instance in kg/hr, are thereby determined, in addition to other invariable parameters, by the speed of the aforesaid reciprocating motion in the directions of the arrows 15 and by the depth of penetration of the rotating extraction milling roll or roller 14 at the surface of the fiber bales 2, as well as by the circumferential speed of the rotating extraction milling roll or roller 14.

The coarse cleaning machine 4 comprises a cleaning roll or roller 16, at the circumference of which there are mounted beater spikes 17 which convey the supplied fiber flocks in known manner past cleaning rods 18 arranged at a part or segment of the circumference of the cleaning roll or roller 16. These cleaning rods 18 are adjustable in their position relative to the cleaning roll or roller 16 such that the intensity of cleaning is variable. This variability is schematically illustrated by a dash-and-dot line 19.

Furthermore, a brightness sensor or an ultrasonic sensor 20 measures the brightness or the sound or acoustical reflection, respectively, as a measure for the proportion of dirt of the waste discharge separated or eliminated. by the cleaning rods 18 and collected in a collecting bin or hopper 21. This collecting bin or hopper 21 is a two-part construction, whereby a lower part 22 is freely movable relative to an upper part 23 and supported at measuring pressure boxes or cells or supports 24. In this manner, the lower part 22 forms a weighing container or bowl for the aforesaid waste discharge. In predetermined time intervals, the discharge is sucked out by means of a suction conveyance 55. The weight measurement of this waste discharge is interrupted during suction removal thereof. The determination of the discharge quantity can be also indirectly effected by volume measurement per unit of time by means of light barriers, taking into account the variable density as a function of the proportion of dirt.

The fine cleaning machine 6 comprises a cleaning roll or roller 25 which is selectively provided with saw tooth clothing or other types of clothings, in order to open the supplied fiber flocks in yet finer manner than the cleaning achieved in the aforenoted coarse cleaning machine 4.

The fiber flocks are thereby fed to the cleaning roll or roller 25 by means of an infeed roller 26 and a therewith coacting feed plate 27 which is pivotable about a swivel or pivot axle 50. The mode of operation of such fiber infeed means is known to the art and, therefore, will not be further described., However, it should be noted that the, spring-loaded feed plate 27 is pressed with a predetermined force in the direction of the infeed roller 26 and that the swivel or pivot axle 50 is pivotable about the axis of rotation 51 of the infeed roller 26 to a predetermined extent in the directions of the arrows S and S.1, respectively. This angular motion is characterized by a radius conveniently designated by reference character R. In this manner, it is possible to move the clamping or nip line of the fibers infed between the infeed roller 26 and a fiber discharge edge 52 of the feed plate 27 around the circumference of the infeed roller 26, so that short fibers are fed into a clamping or nip line displaced generally in the downstream direction, when viewed in the direction of fiber travel, while long fibers are fed into a clamping or nip line displaced generally in the upstream direction. By virtue of this measure, fiber shortening during fiber infeed can be entirely precluded.

Instead of the spring-loaded feed plate 27, the infeed roller 26 can be spring-loadedly narrowed toward or relative to the feed plate 27. In such a case, the feed plate 27 is pivotably arranged to swivel in a permanent path (not shown) about a predetermined axis of rotation of the spring-loaded infeed roller 26.

The fiber flocks fed to the cleaning roll or roller 25 are engaged by the latter and conducted or directed past suitable cleaning elements 28 arranged around a part of the circumference of the cleaning roll or roller 25. These cleaning elements 28 can be carding elements or knives with and without sheet-metal guides or baffles between such knives or the like. However, these cleaning elements 28 are structured or formed in such a manner that their cleaning intensity is variable, such variability being schematically illustrated by a dash-and-dot line 29.

In a manner analogous to the construction of the coarse cleaning machine 4, the fine cleaning machine 6 also comprises a collecting bin or hopper 21.1 subdivided into a lower part 22.1 and an upper part 23.1 for collecting the waste discharge, whereby this collecting bin or hopper 21.1 is supported by measuring pressure boxes or cells or supports 24.1, as hereinbefore described. Likewise,. the brightness is measured by a brightness sensor 20.1 and the waste discharge is sucked out by means of a suction conveyance 55.1. Analogously, an ultrasonic sensor can also here replace the brightness sensor 20.1, or volume measurement can be used instead of weight measurement of the waste discharge.

A rectangle conveniently designated by reference numeral 30 is schematically outlined by dash-and-dot lines to illustrate that still further cleaning machines or machines with cleaning functions analogous or similar to the mode of operation of the fine cleaning machine 6 can be provided, whereby it is meant to establish that the invention is not limited to the combination-of machines depicted in FIG. 1.

The feeding device 8 comprises an infeed shaft 31 as well as two infeed rollers 32 conveying the fiber flocks to an opening roll or roller 33, by means of which the fiber flocks are even further reduced in size, i.e. the fiber flocks are further opened.

These further, i.e. finer, opened fiber flocks fall into a lower feed chute or shaft 34 and are subsequently discharged by two feed rollers 35 and pressed between a contact or pressure roll or roller 36 and one of the two feed rollers 35 to form the aforenoted fiber batt or lap 9 which is subsequently guided in the chute or slide 10 toward a feed roller 37 of the card or carding machine 11.

The fiber batt or lap 9 is further conveyed in known manner from the feed roller 37 to a licker-in roll or cylinder 39 provided with a spiked or toothed clothing, by means of which the fiber batt or lap 9 is opened such as to form a thin fiber web which is conveyed to the main carding cylinder 40.

The carding process is known as such and, therefore, need not be here further referred to. However, it is worthy of note that the licker-in roll or cylinder 39 can comprise cleaning elements 41 located at a part or segment of the circumference of the licker-in roll or cylinder .39, the intensity of cleaning of such cleaning elements 41 being adjustable. The adjustability of such cleaning elements 41 is schematically illustrated. by a dash-and-dot line 42. The cleaning waste discharge of these cleaning elements 41 is a finer discharge than that of the fine cleaning machine 6. In other words, also the cleaning intensity is correspondingly adjusted.

A weighing bowl or receptacle 59 supported at measuring pressure boxes or cells or supports 58 is provided for collecting and measuring the cleaning waste discharge of the cleaning elements 41, such weighing bowl or receptacle 59 being connected to a suction conveyance 60. The proportion of actual dirt in the cleaning waste discharge is measured by means of a brightness sensor 20.2 or by means of an appropriate ultrasonic sensor and is periodically sucked out in analogous manner to the suction conveyances 55 and 55.1.

The web lying on the main carding cylinder 40 is taken over by a doffer or doffing roll or cylinder 43 and compressed or condensed between following compression rolls or rollers and a web condenser 44 to form the aforenoted carded or card sliver 12. This carded or card sliver 12 is further inspected and examined in a measuring funnel-shaped hopper 46 for Micronaire fineness of the fibers of the carded or card sliver 12. Subsequent to this measuring funnel-shaped hopper 46, a pair of measuring rolls or rollers 47 transmits the quantity or output of carded or card sliver 12 per unit of time, e.g. in m/min., as a signal S.47 still to be described hereinafter.

Finally, the carded or card sliver 12 is inspected or checked for its color by means of a color sensor 48 prior to conveying the carded or card sliver 12 to the can coiler The aforenoted optimization is accomplished with the aid of a microcomputer control unit 53. Into this microcomputer control unit 53, the original or input or given data, i.e. the fiber characteristics, such as staple length designated by reference character St, Micronaire fineness designated by reference character M, fiber strength designated by reference character F, fiber elongation designated by reference character D, as well as the measured or assessed proportion of coarse dirt designated by reference character GR, and fine dirt designated by reference character FR, are entered either per fiber bale 2 or as a computed mean value of the entire bale feed, such mean value being computed externally or independently of the microcomputer control unit 53.

If the original or input or given data are entered per fiber bale 2, then the microcomputer control unit 53 computes the mean value on its own. Furthermore, the degree of cleaning of the product and conveniently designated by reference character RG, the throughput of the product or the performance rated in kg/hr and designated by reference character L, and the possible fiber impairment designated by reference character FB can also be entered into the microcomputer control unit 53. For these three variables RG, L and FB there is for each variable a possibility of entering a priority relative to the respective other two variables. However, it is also possible to enter a priority for two variables with respect to the third variable.

The aforementioned priority is determined by an input into the microcomputer control unit 53, such input being not particularly shown in the drawings. As a rule, the desired performance L and the desired degree of cleaning RG are each entered with priority, so that the microcomputer control unit 53 on the basis of the entered original data and the entered dirt proportions, on the one hand, computes and displays and/or automatically sets the data for adjustable operating members and, on the other hand, indicates the possible fiber impairment computed therefrom.

It is then possible for the operating staff to accept this value of possible fiber impairment or, if not, to undertake a correction either of the value of the-degree of cleaning RG or of the value of the performance L which results in that the-microcomputer control unit 53 immediately computes, in each case and with every new setting of the adjustable operating members, the new value of the possible fiber impairment.

This operation can be repeated until the three variables indicate acceptable values. This applies to a firmly given or declared fiber bale feed with the mean values of the: aforementioned original or input or given data computed therefrom. The decision whether the values for the three variables are acceptable or not, depends upon the type of yarn to be produced or the type of application of the respective yarn.

In a variant, the microcomputer control unit 53 is additionally programmed by the input of yarn use or application. This input not specifically illustrated in the drawings is accomplished with first priority, through which the degree of cleaning RG and the possible fiber impairment FB are essentially given, so that the performance L computed from the original or input data and the given dirt proportion must be accepted.

In a further variant, the fiber bale feed is adapted by selecting other bale provenances or origins until, on the basis of new original or input data, the three variables RG, L and FB then fall within respective tolerated limits.

This can be accomplished in one case by recomputing the aforementioned mean value of the individual original or input or given data and by entering these individual original data into the microcomputer control unit 53.

In another case, representing a further variant, the microcomputer control unit 53 is programmed such that the original or input or given data of each bale provenance or origin from a variety of bale provenances or origins are entered into the microcomputer control unit 53, and the microcomputer control unit 53 then undertakes on its own the selection of the bale provenances or origins by entering either the degree of cleaning RG, the performance L, and the tolerated fiber impairment FB, or the use or application of the yarn and the performance L. These entries or inputs of the original or given data are effected per bale provenance or origin on the keyboard described hereinafter.

In connection with bale provenances or origins graduatable in different variations, reference is made to a method of blending textile fibers, in which fibers of different types are extracted from bales of varying origin and are blended, wherein the bales are combined to form fiber-blend components each having different but predetermined fiber properties, such method being disclosed, for example, in U.S. patent application Ser. No. 07/400,693, filed Aug. 30, 1989 by the present Assignee, Rieter Machine Works Limited, located in Winterthur, Switzerland, now U.S. Pat. No. 5,025,533 issued Jun. 25, 1991.

A further additional variant provides for the entry or input of the costs (not shown) of the individual fiber bale provenances or origins present in the fiber bale feed as well as the entry or input of a specified or predetermined value indication for the yarn to be produced, in order to either adhere to the specified profit margin within predetermined limits, whereby the tolerance range with respect to the degree of cleaning RG and the fiber impairment FB is correspondingly increased, or accept the profit margin obtainable by retaining normal tolerance limits relative to the degree of cleaning RG and the fiber impairment FB.

However, this requires that new priorities concerning profit margin, degree of cleaning RG and fiber impairment FB have to be set, since this necessitates appropriate decisions to be taken by the operating staff.

The entry of the original or input data, the proportion of the different types of dirt, the degree of cleaning, the throughput quantity or performance and the probable fiber impairment is effected by means of correspondingly suitable digital keyboards or analog slides, for instance potentiometers, which are only schematically illustrated in FIG. 1 and conveniently designated by the aforementioned reference characters St, M, F, D, GR, FR, RG, L and FB. These nine individual input data are entered into the microcomputer control unit 53 by means of respective input signals st, m, f, d, gr, fr, rg, l and fb. The entries of the input signals rg, 1, and fb are indicated at displays A.RG, A.L and A.FB in such a manner that, for example, the performance L is indicated in kg/hr, the degree of cleaning RG is indicated as a percentage and the probable fiber impairment FB, which practically results in a fiber shortening, is indicated as a percentage of the staple length St.

From these three last-mentioned data, the microcomputer control unit 53 computes the setting or adjustment values for the respective adjustable operating members and indicates these setting or adjustment values at the respective appropriate displays.

In the simpler variant the operating staff effects the setting or adjustment of the adjustable operating members, while in the "automatic" variant such setting or adjustment is accomplished by the microcomputer control unit 53.

The description following hereinbelow relates to the "automatic" variant of the process of setting adjustable operating members:

For the bale opener or opening device 1, the microcomputer control unit 53 delivers an output signal S.14 which determines the rotational speed of the rotating extraction milling roll or roller 14. This rotational speed is indicated by a display A.14. A further output signal S.15 determines the feeding or transverse linear speed of reciprocating motion in the directions of the arrows 15 and indicates this feeding or transverse linear speed in m/min, for instance, by a display A.15. A third output signal S.61 determines the specific depth of penetration of the rotating extraction milling roll or roller 14. The term specific penetration depth relates to the depth of penetration at the start of the fiber extraction process, since the depth of penetration is altered during fiber extraction because of the varying density of the fiber bales 2 depending upon the remaining height of the fiber bales 2, such change in depth being effected by inherent control of the bale opener or opening device 1. A control of this type is disclosed, for example, in European Patent No. 0,193,647, published Sep. 10, 1986 of the present Assignee, Maschinenfabrik Rieter AG, located in Winterthur, Switzerland. It is readily conceivable that with one determined variable and/or with automatic selection of the bale provenances or origins by the microcomputer control unit 53, the specific depth of penetration for each bale provenance or origin is provided by the microcomputer control unit 53.

The microcomputer control unit 53 delivers an output signal S.16 for a coarse cleaning machine 4. This output signal S.16 influences the rotational speed of the cleaning roll or roller 16 and is indicated at a display A.16, while an output signal S.19 causes the setting or adjustment of the cleaning rods 18 and indicates such setting or adjustment, for instance by a characteristic angle not particularly shown, at a display A.19.

The brightness of the separated or discharged waste measured by the brightness sensor 20 is entered into the microcomputer control unit 53 as an input signal S.20 and indicated at a display A.20. Likewise, the weight determined by the measuring pressure boxes or cells or supports 24 is entered by means of an input signal S.24 into the microcomputer control unit 53 and indicated at a display A.24. The measurement is thereby effected during predetermined or specified. time intervals, so that the indicated weight is a summation of waste accumulated in such interval of time.

The same process is carried out in the fine cleaning machine 6, in that the microcomputer control unit 53 indicates the values for the rotational speed of the cleaning roll or roller 25 at a display A.25 and provides the appropriate rotational speed by means of an output signal S.25, while the setting or adjustment of the cleaning elements 28 is indicated at a display A.29 and effected by means of an output signal S.29. The display A.29 thereby depends on the type of the cleaning element 28. For example, the percentage intensity can be displayed with cleaning elements 28 which have adjustable intensity.

The brightness measuring unit 20.1 delivers an input signal S.20.1 to the microcomputer control unit 53 in accordance with the brightness of the separated or discharged waste, such input signal S.20.1 being indicated at a display A.20.1 in the same manner as an output signal S.24.1 which is indicated at a display A.24.1 and is the weight signal of the measuring. pressure boxes or cells or supports 24.1. In a manner analogous to the coarse cleaning machine 4, the separated waste of the fine cleaning machine 6 is likewise collected during an interval of time in the lower part 22.1 of the collecting bin or hopper 21.1 and entered as a weight input signal into the microcomputer control unit 53 by means of the aforesaid input signal S.24.1.

This fine cleaning machine 6 is provided with a further signal S.50 which is incoming from the microcomputer control unit 53 and which provides for correct positioning of the swivel or rotational axle 50 in accordance with the staple length of the fibers to be processed.

The rotational speed of the opening roll or roller 33 in the feeding device 8 can be controlled with the. aid of a signal S.33 arriving from the microcomputer control unit 53. However, in this case such signal S.33 is considered optional and, therefore, is indicated by broken lines.

The performance of the entire installation is primarily dictated by the performance of the card or carding machine 11, namely by the rotational speed of the feed roller 37. This performance, as already mentioned, is either entered by the input L by means of the input signal 1 into the microcomputer control unit 53 and indicated at a display A.L and accomplished by means of an output signal S.37 or, according to hereinbefore mentioned allocation of priorities, only indicated and correspondingly set according to allocated priorities and appropriate computation, i.e. automatically effected by means of the output signal S.37.

A further control of the performance of the entire installation can be effected by the measuring or flowmeter device 54 located in the conveying route or path 3, which measuring or flowmeter device 54 determines the fiber-flock quantity per unit of time extracted by the bale opener or opening device 1 and enters this determined fiber-flock quantity per unit of time into the microcomputer control unit 53 by means of an input signal S.54, such fiber-flock quantity per unit of time being indicated at a display A.54.

This performance supervision or monitoring with the aid of the card or carding machine 11 and of the measuring or flowmeter device 54, combined with the supervision or monitoring of the waste discharge at the coarse cleaning machine 4 and at the fine cleaning machine 6, is indispensable when the product conveyed in the installation from machine to machine is processed without depot containers located above the cleaning machines. On the other hand, if as a variant the cleaning machines 4 and 6 operate in a stop/go process, then depot containers are provided above the cleaning machines 4 and 6.

However, performance monitoring by means of the measuring or flowmeter device 54 is also advantageous in the variant including depot containers, because the stop times or intervals can thereby be kept as short as possible in a stop/go process or operation.

The aforenoted depot containers substantially correspond with the feeding device 8 if the contact or pressure roll or roller 36 is omitted. The stop/go process or operation is controlled by means of light barriers 56 and 57 which detect or sense the level of the fiber flocks in the lower feed chute or shaft 34 and thereby switch off the preceding or upstream machine, when viewed in the direction fiber-flock travel, at the level of the upper light barrier 56 and switch on again the preceding or upstream machine at. the level of the lower light barrier 57. It is readily conceivable, that the more accurately the performance monitoring is carried out by means of the flowmeter device 54 and the more exactly the weight-discharge monitoring is conducted by means of the measuring pressure boxes or cells or supports 24, 24.1. and 58, the less frequently the cleaning machines are switched on and off.

The resulting measurement signals of the light barriers 56 and 57 are entered into the microcomputer control unit 53 by means of input signals S.56 and S.57 indicated in broken lines. However, these. signals S.56 and S.57 are not provided with respective displays and, therefore, these broken lines are not drawn up to the microcomputer control unit 53.

A further monitored possibility of cleaning the fibers to be processed is provided in the card or carding machine 11 in that the cleaning elements 41, as already mentioned, are adjustable in their cleaning intensity, and this adjustability is schematically indicated by the dash-and-dot line 42.

This cleaning intensity of the adjustable cleaning elements 41 is transmitted from the microcomputer control unit 53 via an output signal S.42 to the cleaning elements 41. The brightness of the waste discharge measured by the brightness sensor 20.2 and the weight measured by the measuring pressure boxes or supports 58 are-entered into the microcomputer control unit 53 by means of respective input signals S.20.2 and S.58 and correspondingly indicated by the microcomputer control unit 53 with respective displays A.20.2 and A.58. The performance of the card or carding machine 11 is given by the aforenoted feed roller 37 and likewise by the doffer or doffing roll or cylinder 43, this being the reason why the rotational speed of this doffer or doffing roll or cylinder 43 is controlled by means of a signal S.43 of the microcomputer control unit 53 and indicated in a display A.43.

At the outlet of the card or carding machine 11, the fineness of the fibers in the carded or card sliver 12 is entered into the microcomputer control unit 53 as a signal S.46 of the measuring funnel-shaped hopper 46 with an appropriate display A.46. This measurement is a control of the pertinent fiber bale feed, i.e. of the correct combination of fiber bale provenances or origins.

The actual carded-sliver performance, for instance in m/hr, is measured with the aid of the pair of measuring rolls or rollers 47, a signal S.47 of which is entered into the microcomputer control unit 53 and suitably displayed at the display A.47. The difference between the quantity infed by the. feed roller 37 in conformity with the rotational speed thereof. and the quantity determined by the pair of measuring rolls or rollers 47 is the proportion of dirt and short fibers eliminated by the card or carding machine 11.

A further control of the entire blend or mixture of the bale provenances or origins and of the opening and cleaning process is effected by the brightness control of the color sensor 48 which scans the carded or card sliver 12 for its color and/or brightness and enters the result in the microcomputer control unit 53 by means of a signal S.48 and indicates such result by a display A.48. This control is not concerned with the cleaning effect or efficiency of the preceding machines, but rather with the basic color of the fibers, i.e. with the correct composition of the fiber bale feed. If the shade of color is incorrect in this control, then an alarm is given for the operating staff in the case of non-automatic installations. In other cases, the microcomputer control unit 53 determines the altered fiber bale feed. This control is only possible at this location, because further upstream the control of not yet entirely cleaned fiber material would be incorrect or falsified due to residual contamination.

Finally, for the aforesaid optimization, the temperature and the humidity of the room can also be taken into consideration and entered for computation and indicated by respective displays A.T and A.Fe.

Figure 2:
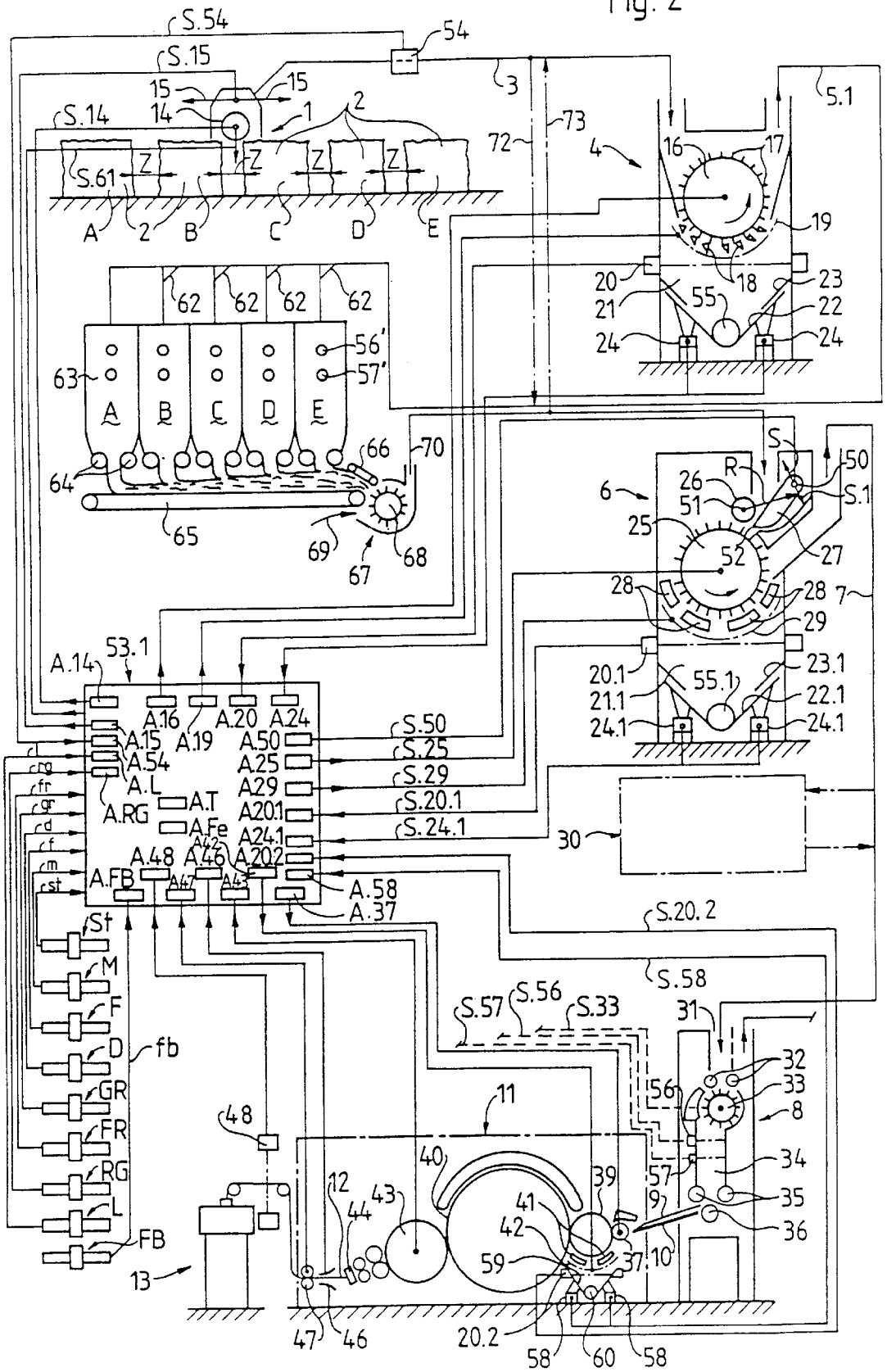
FIG. 2 shows a variant of the schematic flow diagram depicted in FIG. 1.

FIG. 2 shows, in comparison with FIG. 1, a variant in that the fiber bales are conveniently designated by reference characters A, B, C, D and E which represent five different provenances or origins, whereby a spacing or clearance Z is provided between the five individual fiber bales A through E, such spacing or clearance Z being defined hereinbelow.

The fiber flocks extracted by the bale opener or opening device 1 from the individual fiber bales A through F of different provenances or origins are conveyed via conveying route or path 3 into the coarse cleaning machine 4 and from the latter via a conveying route or path 5.1 into individual component depots 63, namely one depot per provenance or origin, so that these component depots 63 are conveniently designated with the same reference characters as the fiber bales A through F. Also when several fiber bales 2 of the same provenance or origin are arranged next to one another, it is advantageous to have a depot 63 for each fiber bale 2, in order to obtain a more homogeneous blend or mixing.

Branches 62 are provided in the conveying route 5.1, so that the filling of the component depots 63 can be directly controlled. In the case of pneumatic conveyance, such branches 62 can be so-called tube switches.

Each component depot 63 comprises a pair of extraction or output rolls or rollers 64, by means of which the fiber flocks located in the component depot are extracted and placed on a conveyor belt or band 65. On this conveyor belt or band 65 the fiber flocks out of all of the component depots 63 are brought together as superimposed layers, as is apparent from FIG. 2, and conveyed toward a compression element 66, for example, a small conveyor belt or band, by means of which the main conveyor belt or band 65 conveys the entire fiber layer to an opening element 67 with an opening roll or roller 68. With the aid of this opening element 67 and of a-sucked-in current of air 69, the fiber flocks are conveyed via a conveying route or path 70 to the fine cleaning machine 6.

In a not particularly illustrated variant in which the fine cleaning machine 6 is located directly below the compression element or small conveyor belt or band 66, the layer comprising the superimposed layers can be directly conducted into the fine cleaning machine 6.

A microcomputer control unit 53.1 of the installation depicted in FIG. 2 comprises essentially the same microcomputer for computation purposes as the microcomputer control unit 53 of FIG. 1. However, the microcomputer control unit 53.1 comprises an additional feature in that the original or input or given data of the fibers are entered into the microcomputer control unit 53.1 for each individual provenance or origin, so that the microcomputer sets the adjustable operating members of the coarse cleaning machine 4 for each provenance or origin.

In order to gain time for setting or adjusting the adjustable operating members of the coarse cleaning machine 4, without having to stop the bale opener or opening device 1 between the individual provenances or origins A through E, the spacing or clearance Z is of an appropriate predetermined length. The resetting of the adjustable operating members takes places either solely in one direction 15 of the reciprocating motion of the bale opener or opening device 1, or in both directions of the reciprocating motion, depending upon whether flock extraction is effected in one or in both directions according to the arrows 15.

The measuring or flowmeter device 54 for monitoring the performance of the bale opener or opening device 1 has the same function as in the installation or arrangement depicted in FIG. 1, since photoelectric cells 56' and 57' in the component depots 63 are only provided for safety purposes, in order to signal disturbances in the fiber feed or in the feed performance. Therefore, these photoelectric cells 56' and 57' are likewise connected with the microcomputer control unit 53.1, which connection is not particularly illustrated in the drawings.

Of course, the opening performance of the extraction or output rolls or rollers 64, the conveying performance of the main conveyor belt or band 65 and of the compression element 66, as well as the rotational speed of the opening roll or roller 68 are controlled by the microcomputer control unit 53.1.

For the remaining elements not mentioned again in conjunction with the arrangement depicted in FIG. 2, there have been generally conveniently used the same reference numerals and characters as used in FIG. 1 for components of analogous function.

The advantage of this variant is seen in the fact that the individual fiber bales or bale provenances A through E can be differently cleaned and that homogeneous blending of the individual fiber provenances can be effected.

Figure 3:
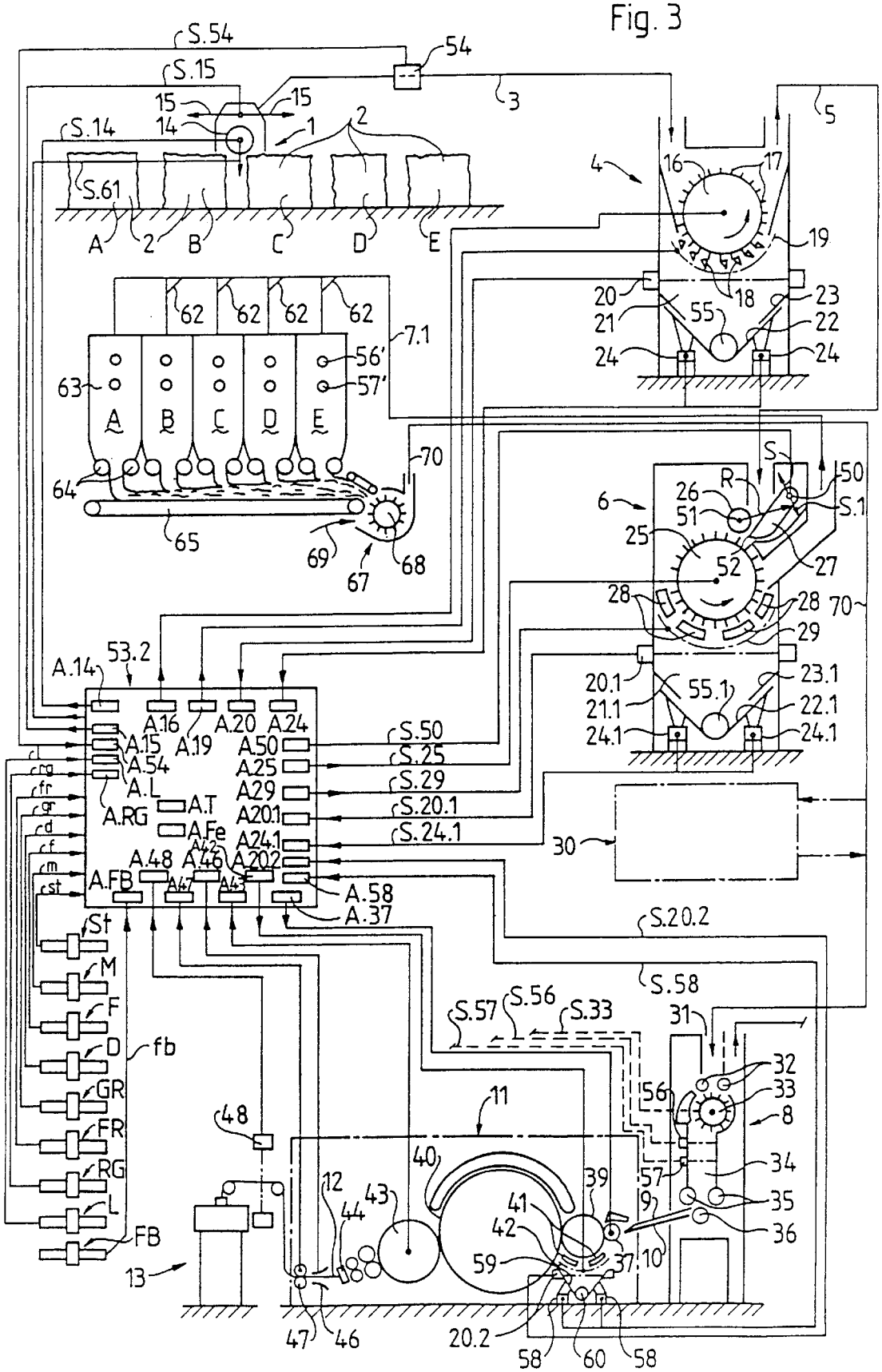
FIG. 3 shows a variant of the schematic flow diagram depicted in FIG. 2.

FIG. 3 shows in comparison with FIG. 2 a variant in that the individual provenances or origins are also cleaned by the fine cleaning machine 6 prior to being conveyed into the respective component depots 63. Accordingly, the fiber flocks leaving the fine cleaning machine 6 are conveyed via a conveying route or path 7.1 and via respective branches 62 into the component depots 63. After blending the different provenances or origins, the fiber flocks are conveyed, subsequent to opening thereof by the opening roll or roller 68, via a conveying route or path 70 to the feeding device 8. The microcomputer control unit of this installation variant is conveniently designated by reference numeral 53.2.

For the remaining elements not mentioned again in conjunction with the arrangement in FIG. 3 there have been generally used the same reference numerals and characters as used in FIG. 2 for components of same or analogous function.

The advantage of this variant is seen in the possibility of cleaning the fiber flocks-of the individual different provenances by the coarse cleaning machine 4 as well as by the fine cleaning machine 6 prior to blending the individual provenances or origins.

It is readily conceivable that, as mentioned hereinbefore, if it is necessary to resort to further provenances in order to meet the requirements of the yarn to be produced, that then the microcomputer control unit 53.2 and the installation are appropriately augmented with the corresponding number of possibilities with regard to fiber extraction and fiber blending.

This type of microcomputer control unit is not limited to the application of a complete installation, but that also individual machines can be appropriately controlled by the same system, such individual machines in the spinning mill comprising adjustable operating members for altering the product and control members for monitoring such alteration.

Furthermore, as is apparent from FIG. 2, dash-and-dot lines 72 and 73 indicate the possibility that the product of the bale opener or opening device 1 can first be conveyed to the component depots 63 in order to arrive as a fiber blend at the coarse cleaning machine 4.

Figure 4:
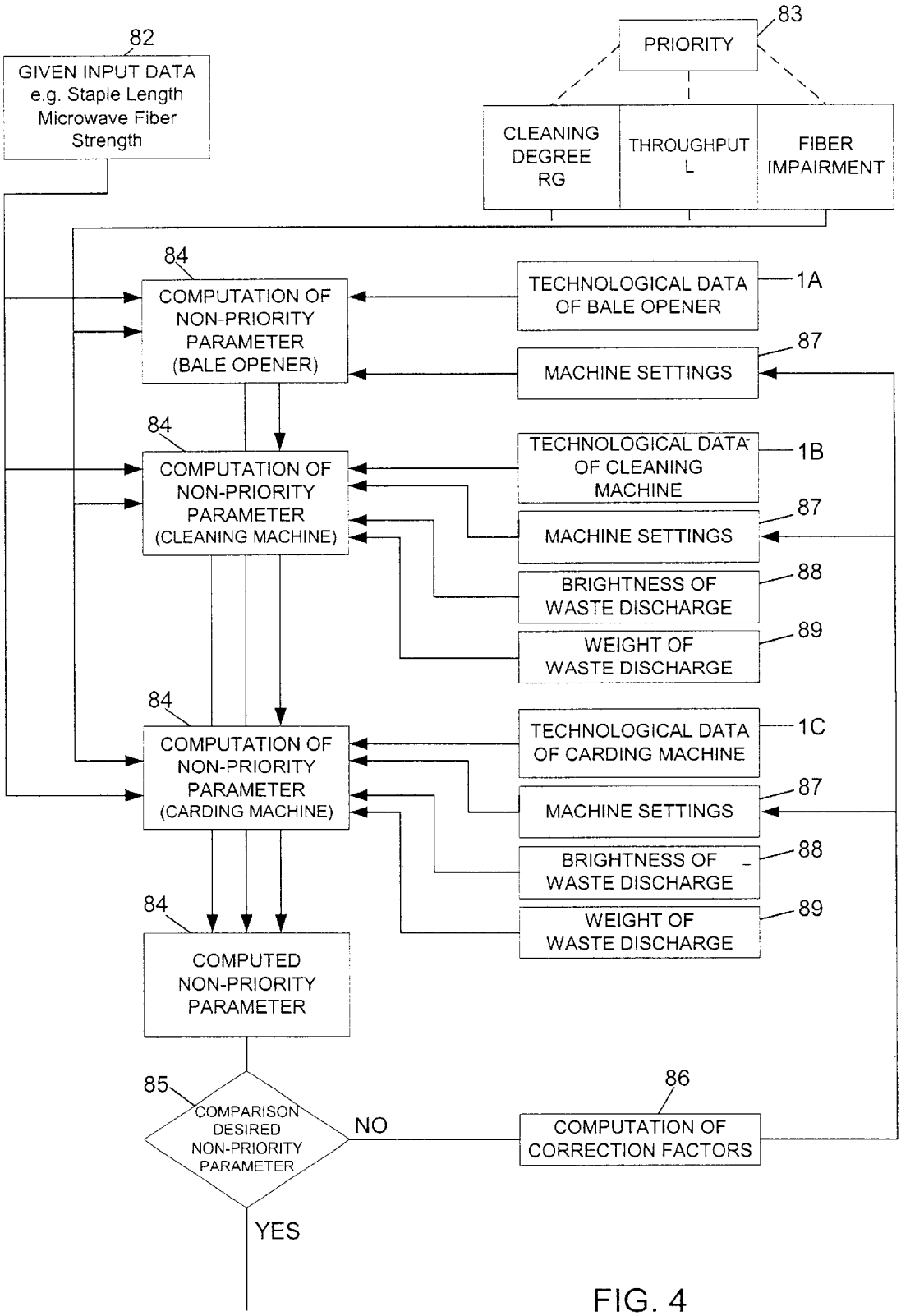
FIG. 4 shows a flow chart, schematically illustrating a representative embodiment of the invention.

FIG. 4 summarizes, in a schematic flow chart, the logical flow by which a textile installation can be operated in accordance with the foregoing description.

As mentioned in the summary of the invention, above, the invention includes a method and installation for cleaning cotton by means of which the processed cotton is cleaned in an efficient and economical manner from the standpoint of commercial considerations in conjunction with the accurate bale opening and the careful fiber cleaning as specified and required in terms technological considerations. This socalled optimization can vary depending upon the use to which the cleaned fibers is put in a particular spinning method, for example. As also mentioned above, in order to satisfy the technological considerations or requirements, the opening of the fiber bales should result in fiber flocks of the smallest flock size. Further, the rotational speed and intensity of the opening rollers, in combination with knife or carding elements, should be such that fiber damage is minimized.

The control means, i.e., the microcomputer control unit, is programmed such that the control means delivers predetermined control signals based upon the entered original or input or given data, the throughput quantity of the carded sliver and the entered desired degree of cleaning.

More specifically, and with reference to FIG. 4, the given input data 82 (i.e., fiber characteristics such as staple length, Micronaire fineness, fiber strength, e.g.) are inputted to the control means. Further inputted into the control means, as shown at reference numeral 83, are values for three priority parameters, viz., the degree of cleaning RG, the throughput L and the possible fiber impairment FB. For these three variables, a priority can be indicated for one or two with respect to the other(s).

The technological data of the bale opener, cleaning machines and carding machine 1A, 1B and 1C are inherently known and are inputted to the control means. More specifically, the technological data 1A of the bale opener 1 determines the rotational speed of the extraction roller 14, the transverse linear speed of the reciprocating motion (arrows 15) and the specific depth of penetration of the rotating extraction milling roller 14.

Likewise, the technological data of the cleaning machines influences the rotational speed of the cleaning roller 16 and the adjustment of the cleaning rods 18 of the coarse cleaning machine 4 and the rotational speed of the cleaning roller 25 and the adjustment of the cleaning elements 28 of the fine cleaning machine 6.

Further, the technological data of the carding machine influences the adjustment of the cleaning elements 41 in their cleaning intensity. Similarly, the rotational speeds of the feed roller 37 and the doffing cylinder 43 are controlled.

From these input data, i.e., the given input data 82, the priority parameters RGl L, FB, and the technological data 1A, 1B, 1C, the machine settings 87 or the data for adjustable operating members are computed at 84.

If the computed non-priority parameter is found to be not acceptable, i.e., if the value of the parameter is not within certain prescribed limits when such comparison is made at 85, the desired or set non-priority parameter correction factors are calculated at 86 and the machine settings are changed on that basis.

Additionally, the brightness of the waste discharge 88: measured by the brightness, sensors 20, 20.1 and the weight of the waste discharge determined by the measuring pressure supports 24, 24.1 for the cleaning machines 4, 6 are entered into the control means. Also, the brightness of the waste discharge measured by the brightness sensor 20.2 and the. weight measured by the measuring pressure supports 58 for the. carding machine 11 are entered into the control means.

While there are shown and described present preferred embodiments of the invention, it is to be distinctly understood that the invention is not limited thereto, but may be otherwise variously embodied and practiced within the scope of the following claims. ACCORDINGLY,

We claim:

1. A fiber processing facility comprising:

a bale opening machine;

a coarse cleaning machine;

a control system, coupled to the bale opening machine and the coarse cleaning machine, identifying a fiber material to be processed; and the control system adjusting the processing parameters of the coarse cleaning machine according to the identity of the fiber material delivered by the bale opening machine.

2. The fiber processing facility according to claim 1, the control system comprising a microcomputer control system.

3. The fiber processing facility according to claim 1, the coarse cleaning machine comprising a rotatable cleaning roller; and the control system influencing a rotational speed of the cleaning roller.

4. The fiber processing facility according to claim 1, the coarse cleaning machine comprising a plurality of cleaning rods; and the control system adjusting the positioning of cleaning rods.

5. The fiber processing facility according to claim 4, the control system angularly adjusting the positioning of the cleaning rods.

6. The fiber processing facility according to claim 1, the control system adjustably setting the processing parameters of the coarse cleaning machine when a different fiber material is introduced to the bale opening machine.

7. The fiber processing facility according to claim 6, the bale opening machine comprising a fiber material delivery device delivering at least the fiber material and the different fiber material, the fiber material and the different fiber material having predetermined fiber characteristics;

the fiber material and the different fiber material spaced apart on the fiber material delivery device at a predetermined distance, the predetermined distance related to a specified value so that the fiber bale opening device does not pause to readjust for a next fiber material.

8. The fiber processing facility according to claim 1, the bale opening machine comprising an extraction milling roller; and the control system adjusting at least one of the rotational speed, transverse linear speed, and depth of penetration the extraction milling roller.

9. The fiber processing facility according to claim 1, the control system, in accordance with the identity of the fiber material, identifying predetermined fiber characteristics of the fiber material.

10. A controlled cleaning process for fiber material in a fiber processing facility including a bale opening machine, a coarse cleaning machine, and a control system, coupled to the bale opening machine and the coarse cleaning machine, the process comprising:

opening the fiber material with the bale opening machine;

delivering the fiber material to the coarse cleaning machine;

identifying the fiber material to be processed; and adjusting a processing parameters of the coarse cleaning machine depending upon the identity of the fiber material delivered by the bale opening machine.

11. A process according to claim 10, further comprising:

adjusting a throughput quantity of the fiber material to influence a residual dirt content and a fiber impairment of the fiber material.

* * * * *

UNITED STATES PATENT AND TRADEMARK OFFICE

CERTIFICATE OF CORRECTION

PATENT NO. : 6,408,221 B1
DATED : June 18, 2002
INVENTOR(S) : R. Demuth et al.

It is certified that error appears in the above-identified patent and that said Letters Patent is hereby corrected as shown below:

Title page,
Item [73], Assignee, "Maschinenfabrik Reiter AG, Winterthur (CH)" should be
-- Maschinenfabrik Rieter AG, Winterthur (CH) --

Signed and Sealed this

Tenth Day of December, 2002

JAMES E. ROGAN
*Director of the United States Patent and Trademark Office*